United States Patent [19]

Jungman

[11] 4,444,289

[45] Apr. 24, 1984

[54] CONSTRUCTION PLATFORM AND METHOD

[76] Inventor: Emil A. Jungman, 1027 Moody Dr., Escondido, Calif. 92027

[21] Appl. No.: 455,508

[22] Filed: Jan. 4, 1983

[51] Int. Cl.[3] ..... E04G 3/06

[52] U.S. Cl. ..... 182/36; 182/82; 52/749

[58] Field of Search ..... 182/82, 57, 222, 223, 182/36, 113; 52/749

[56] References Cited

U.S. PATENT DOCUMENTS

| | | | |
|---|---|---|---|
| 462,934 | 11/1891 | Thibault | 182/57 |
| 1,574,801 | 3/1926 | Eddington | 182/57 |
| 3,135,351 | 6/1964 | Economos | 182/57 |
| 3,679,026 | 7/1972 | Hansen | 182/57 |
| 3,974,995 | 8/1976 | Blonde | 182/57 |

FOREIGN PATENT DOCUMENTS

| | | | |
|---|---|---|---|
| 267817 | 1/1969 | Austria | 182/82 |
| 1321617 | 1/1963 | France | 182/82 |
| 2347507 | 4/1975 | France | 182/82 |
| 626186 | 9/1978 | U.S.S.R. | 182/82 |

*Primary Examiner*—R. P. Machado

*Attorney, Agent, or Firm*—Norvell E. Von Behren

[57] ABSTRACT

A removable construction device for use in a building under construction is disclosed. The device is partially positioned inside the building and locked to the building and is partially cantilevered outside of the building. The device has a movable platform section that may be positioned inside or outside of the building on the device. Construction materials may thereby be moved into the building or may be removed from the building by use of the device associated with an outside lifting crane.

18 Claims, 6 Drawing Figures

CONSTRUCTION PLATFORM AND METHOD

BACKGROUND OF THE INVENTION

This invention relates generally to a construction device and more particularly to a removable platform for use on a building under construction.

During the construction of a building such as a concrete building, it is necessary to erect many concrete forms prior to the pouring of the concrete floors for the building. After the concrete sets, the forms are dismantled and must then be removed to one of the upper floors. On the upper floors they are then set up ready to be used for pouring the next succeeding floor.

In moving the concrete forms from one floor to another, prior art construction methods would use a large, heavy, wooden platform which would be fastened to the inside of the building and would have a cantilevered section outside of the building. The construction workers would then place the concrete forms on the outside of the platform where an exterior crane would be used to pick up the forms and remove them to the upper floors.

The prior art method hereinbefore described has disadvantages from several standpoints. First the construction workers were required to walk on the platform that was cantilevered outside of the building, resulting in dangerous working conditions. Second the platform was large and bulky and could not be easily moved into and out of the building whenever it was to be repositioned to another floor.

SUMMARY OF THE INVENTION

In order to overcome the problems inherent in the before-mentioned prior art construction platforms, there has been provided by the subject invention a new and novel removable construction device which is partially positioned inside the building and partially cantilevered outside the building and has a movable platform section on the device which may be positioned inside or outside of the building.

The device is locked to the building by locking means in the form of a pair of screw jacks and hydraulic cylinders as taught in the preferred embodiment. The movable platform section allows the construction workers to load the platform section from the inside of the building thereby eliminating the safety hazard encountered in prior type devices.

The applicant's device is constructed with simplified means for moving the device and due to the particular design configuration of the device, the entire platform and frame carrying the platform may be easily removed from the building to an upper floor with relative ease.

There is also taught by the applicant's invention, a method for moving construction materials from one floor of a building under construction to another floor using the applicant's new and novel device hereinbefore described.

Accordingly it is an object and advantage of the invention to provide a simplified construction platform which has a movable platform section positioned on and carried by the frame of the device.

Another object and advantage of the invention is to provide a new and novel removable construction device which may be quickly and easily moved from one floor of a building under construction to an upper floor by use of the simplified moving means of the invention.

Still yet another object and advantage of the invention is to provide a new and novel removable construction device which eliminates the dangers of construction workers outside of the building on a cantilevered platform.

Yet another object and advantage of the invention is to provide a new and novel method for moving construction material from one floor of a building under construction to another floor using the applicant's new and novel removable construction platform.

These and other objects and advantages of the invention will become apparent from a review of the drawings and from a study of the preferred embodiment to be described hereinafter.

DESCRIPTION OF THE PREFERRED EMBODIMENT

Figure 1:
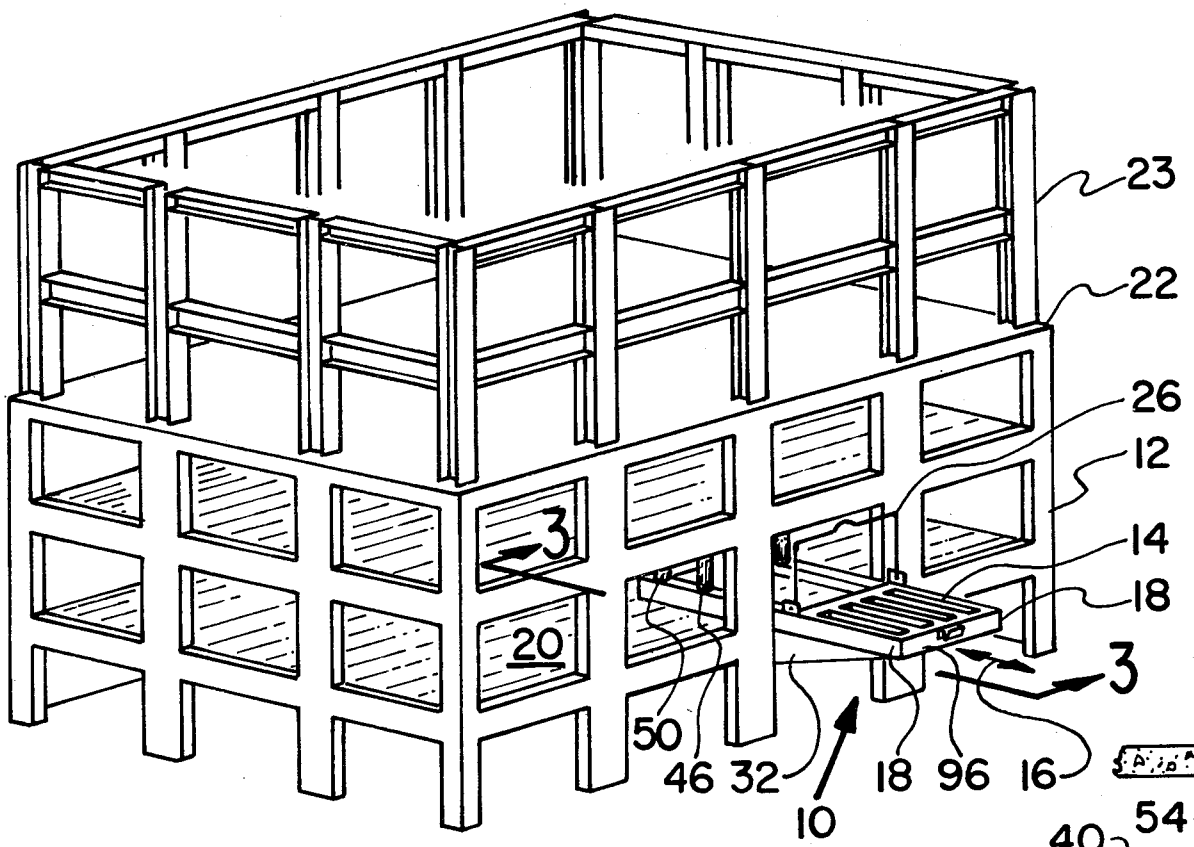
FIG. 1 is a simplified perspective view of a five-story building under construction showing the first three floors of the building having concrete in place and further showing the remaining two stories of the building with only the erected steel columns in place. The applicant's new and novel construction device is shown positioned in the second floor of the building as it would be positioned during use of the device.

Referring now to the drawings in general and in particular to FIG. 1 of the drawings there is shown the applicant's removable construction device generally by the numeral 10. The device 10 is positioned partly inside the building 12 and is partly cantilevered outside of the building as shown in FIG. 1. The device contains a movable platform section 14 which is designed to move in and out of the building in the direction shown by the arrow 16.

The movable section 14 is positioned on and carried by the frame 18 as will be described more fully hereinafter when referring to the remaining figures of the drawings. The construction device 10 is positioned, for normal operation, on the concrete floor 20 of the building 12 and would be designed for use in moving concrete forms from the inside of the building to the outside of the building where they could be picked up by an overhead crane and removed to an upper floor 22 where they would be used for forming the upper floor 23 as the concrete for the entire building is poured during the erection process.

Lifting means are provided on the device 10 in the form of a spreader bar 26 which is pivotably mounted on the frame 18 as will be described more fully hereinafter.

Figure 2:
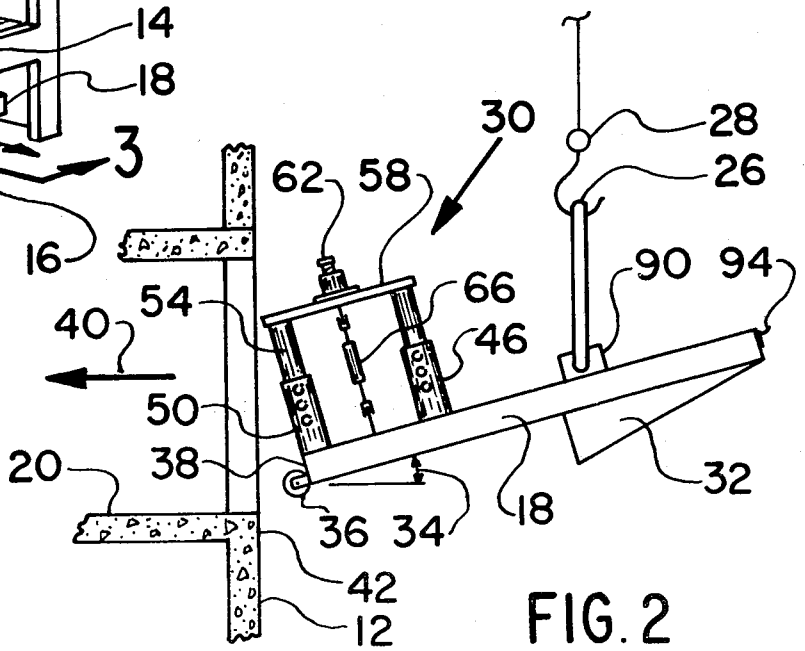
FIG. 2 is a sectional view, taken along line 3—3 of FIG. 1 showing the applicant's construction device being lifted and moved into the position shown in FIG. 1. It is noted that due to the particular design configuration of the device, the particular angle of the device allows it to be easily positioned within the building by an outside construction crane.

Referring now to FIG. 2 of the drawing there is shown a cross-sectional view, taken along line 3—3 of FIG. 1 showing the applicant's construction device being positioned on the building prior to its being locked in place. The spreader bar 26 would be raised to the position shown in FIG. 2 and would be fastened to the crane hook 28 of the existing outside construction crane. Due to the particular design configuration of the applicant's device, the device will tilt as shown in FIG. 2 thereby allowing it to be easily positioned into the building.

Locking means, shown generally by the numeral 30, is fixedly attached to one end of the frame 18. In the preferred embodiment, a reinforcing stop member 32 is fixedly attached to the underside of the frame 18 as shown in FIG. 2. It can be seen that by strategically placing the spreader bar 26 on the frame 18 and locating the locking means 30 and the reinforcing stop member 32, that the lifting of the construction device will cause it to naturally tilt, at the angle shown by the arrow 34, from the horizontal.

The frame 18 also has associated therewith and fixedly attached thereto, guiding means for guiding the frame 18 within the building 12 whenever the frame is positioned for use on a predetermined floor of the building. The guiding means may comprise a pair of rollers 36 rotatably mounted on the end 38 of the frame 18. When mounted thusly it can be seen that the entire construction device could be moved into the building 12 in the direction shown by the arrow 40 with the rollers 36 rolling along the concrete floor 20 until the reinforcing stop member 32 is positioned against the building edge 42 as will be seen more clearly in FIG. 3.

It is within the spirit and scope of the invention that the roller guiding means may also be substituted for a pair of skid plates which would serve the same function in aiding to move the construction device into the building.

Figure 3:
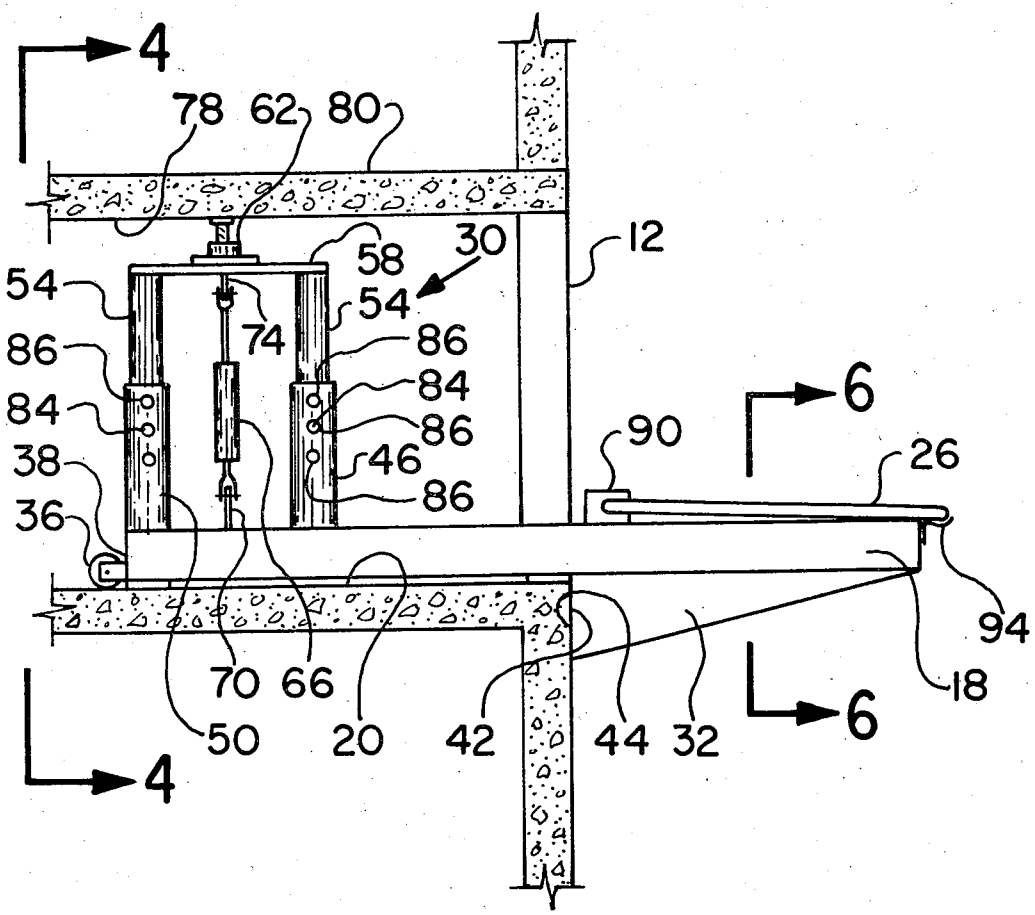
FIG. 3 is a sectional view, taken along line 3—3 of FIG. 1 showing the applicant's device positioned within the building and showing the device locked in place in the building with a portion of the device being cantilevered outside of the building.

Referring now to FIG. 3 of the drawing, there is shown a cross-sectional view taken along line 3—3 of FIG. 1, showing the construction device positioned within the building 12 with the edge 44 of the reinforcing stop member 32 being positioned in juxtaposition to the building edge 42 of the building. It can be seen in FIG. 3 how the stop member 32 also serves as a reinforcement to the frame 18 to reinforce the cantilevered portion of the frame 18 which is positioned outside of the building.

Figure 5:
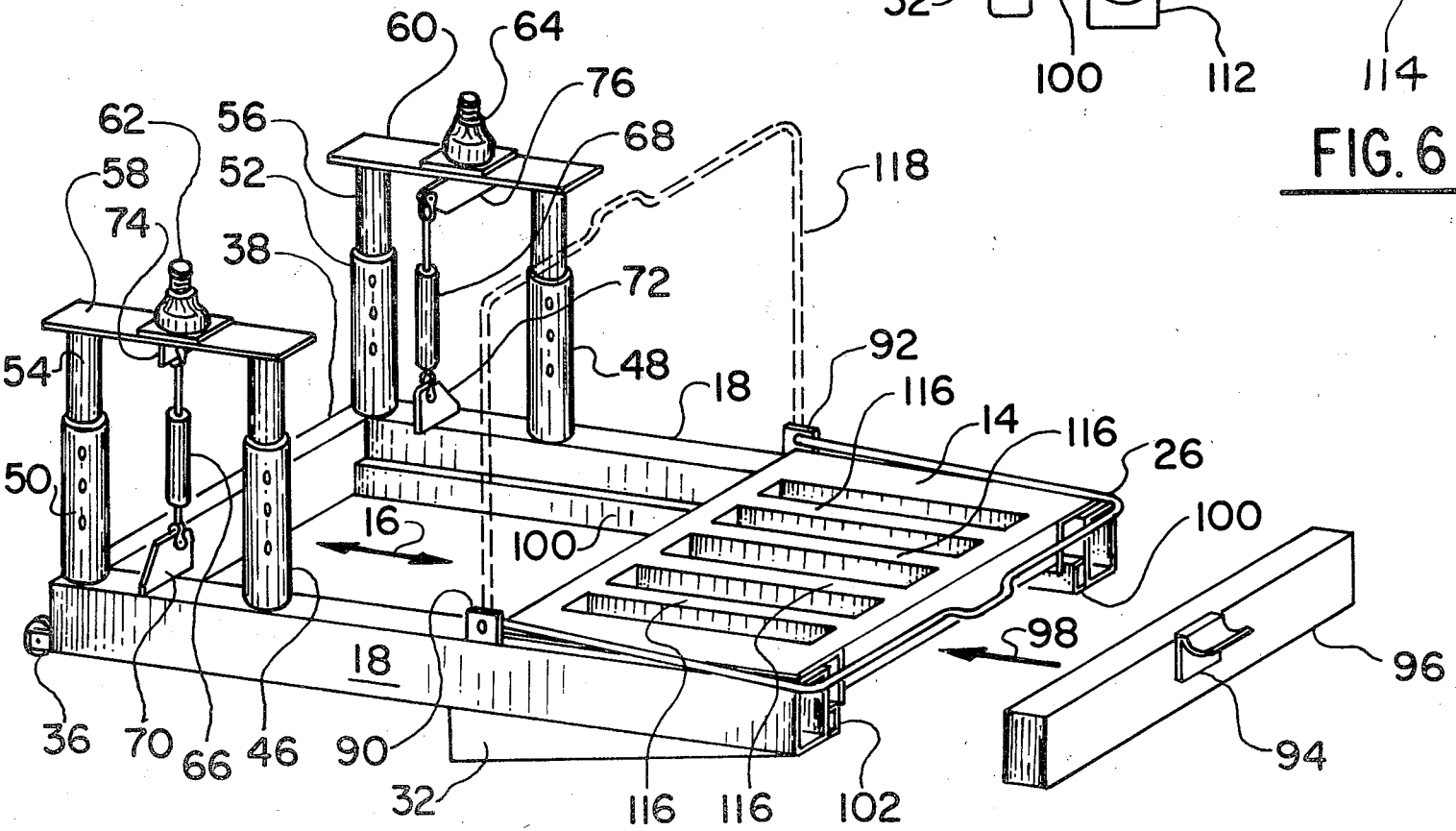
FIG. 5 is a perspective view of the applicant's device showing in greater detail the movable platform portion of the invention and also showing the lifting means used for lifting the device and removing it from a particular floor of the building under construction.

After the construction device has been moved into the building as shown in FIG. 3, the locking means would be utilized to rigidly lock the end 38 of the frame within the building so that the device could function as designed. The locking means may comprise, in the preferred embodiment, at least one upright locking section having positioned thereon at least one jack screw. By referring to FIGS. 3 and 5 of the drawings there can be seen in the embodiment shown that the construction device contains two upright locking sections 46 and 48 which would be fixedly attached by means of welding or some other suitable attachment to the frame 18. The upright locking sections 46 and 48 could be formed by welding a pair of steel pipes 50 and 52 to each side of the frame 18 as shown in FIG. 5 of the drawing. A pair of smaller diameter steel pipes 54 and 56 could then be positioned within the larger diameter pipes 50 and 52 and would have a steel plate 58 and 60 welded thereto. A screw jack 62 could then be fixedly attached to plate 58 and in a similar manner a screw jack 64 could be fixedly attached to the steel plate 60. A hydraulic cylinder 66 and 68 could then be fixedly attached to the frame 18 by means of a welded plate 70 and 72 on one end of the cylinders 66 and 68. The other end of the hydraulic cylinders would be fixedly attached to the steel plates 58 and 60 by means of a welded plate 74 and 76 as shown in FIG. 5 of the drawing.

Figure 4:
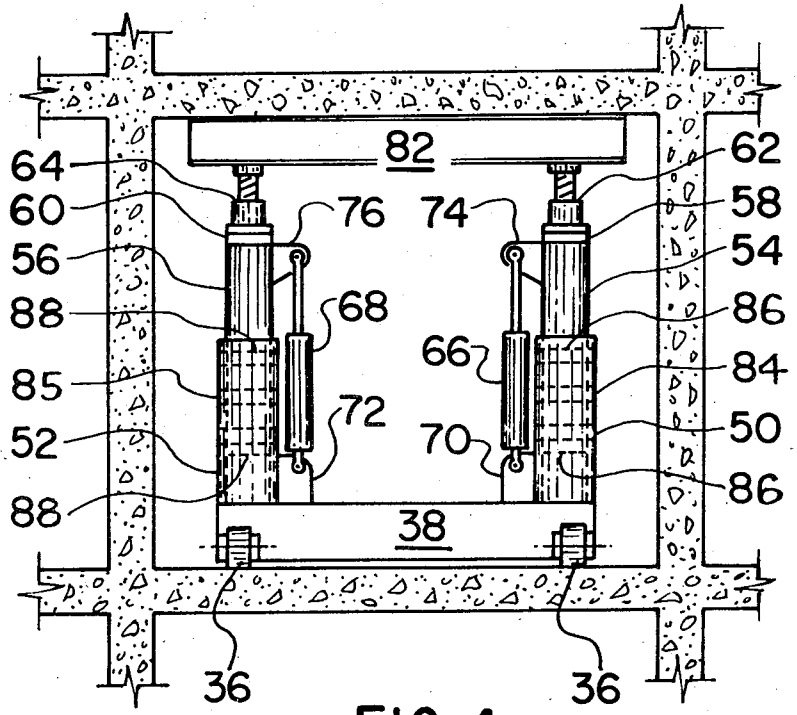
FIG. 4 is a sectional view, taken along line 4—4 of FIG. 3 showing the locking portion of the applicant's device used for firmly locking the end of the device's frame to the building structure.

Referring back to FIGS. 3 and 4 of the drawing, there can be seen how the locking means would function. In FIG. 3 of the drawing it can be seen how the hydraulic cylinders 66 and the opposite hydraulic cylinder 68 could be activated to raise the steel pipes 54 and 56 upward until the screw jack 62 was able to be tightly positioned against the underside 78 of the concrete floor 80. In this manner the construction device 10 would be firmly anchored within the building allowing it to function as designed. By referring to FIG. 4 of the drawing it can be seen how a wooden timber 82 such as a 4×4 or 6×6 could be positioned between the screw jacks 62 and 64 to make up the difference in height whenever a high ceiling was encountered with the device.

When raising the locking section into its locking position, a pair of pins 84 and a pair of pins 85 could be inserted into the steel pipes 50 and 52 through drilled holes 86 and 88 to lock the upright locking sections close to the underside 78 of the floor 80. Thereafter the screw jacks 62 and 64 would be positioned for the final distance to tightly lock the entire device in position within the building.

Referring now to FIGS. 3 and 5 of the drawing there can be seen how the spreader bar 26 is pivotably mounted to the frame 18 by means of a pair of plates 90 and 92 which are welded to the frame and allow the spreader bar to be rotated to a horizontal position so that it can rest in a holder 94 whenever it is not in use.

Figure 6:
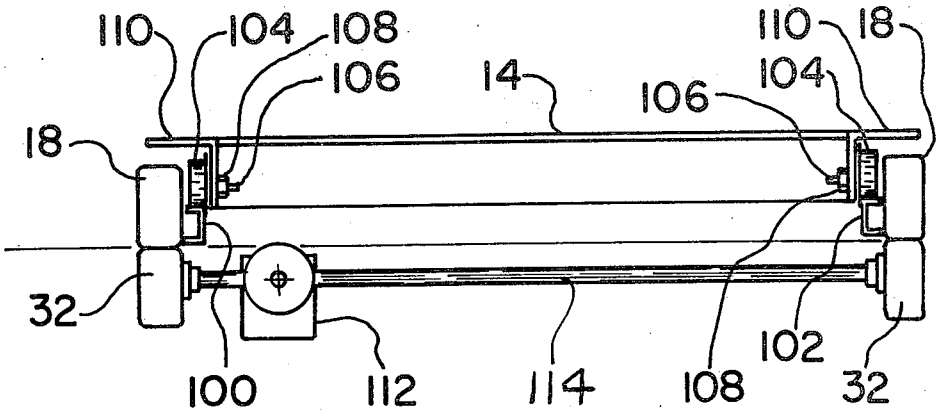
FIG. 6 is a sectional view, taken along line 6—6 of FIG. 3 showing in greater detail the moving platform of the construction device and how it is carried by the outer frame of the device.

Referring now to FIGS. 5 and 6 of the drawing there will be shown in more detail the movable platform section 14 which is designed to move horizontally within the frame 18 in the direction shown by the arrow 16. FIG. 5 has been drawn with the right side of the frame shown open for purposes of clarity in understanding the movable platform section 14. In the final construction version of the applicant's device, a frame 96 would be welded to the two side frames 18 after being positioned in the direction shown by the arrow 98, thus adding stability to the final product.

It can be seen in FIG. 6 how a pair of channels 100 and 102 would be welded to the side frames 18 to form a flat rolling surface upon which a plurality of flange wheels 104 could roll. The wheels 104 would be rotatably mounted by means of the axles 106 and would held in place by means of the nuts 108, to the welded channel 110, forming the movable platform section 14. When formed thusly it can be seen by referring to FIGS. 5 and 6 how the movable platform section 14 would be able to be horizontally positioned on the channels 100 and 102 moving within the frame 18 with the end frames 38 and 96 acting as stops for the platform. A hydraulic motor 112 mounted on an elongated rod 114, which is fixedly attached to the reinforcing stop members 32, would serve as a means to move the platform horizontally in the direction shown by the arrow 16. The attachment to the hydraulic motor 112 and the movable platform section 14 has not been shown for purposes of clarity and it is within the spirit and scope of the invention that other means could be provided to move the platform section 14, such as a cable and winch electrically driven or hand-operated as the circumstances may dictate.

The movable platform 14 could also contain a plurality of reinforcing sections 16 to provide a strong platform surface upon which could be positioned the concrete forms hereinbefore described. It can be also seen in FIG. 5 how the spreader bar 26 may be raised from the horizontal position to the vertical position shown by the dashed lines 118 for purposes of lifting the device.

In the manufacture of the applicant's construction device, appropriate structural steel would be used throughout in order to provide the necessary structural strength and it is within the spirit and scope of the invention that other materials could also be used as desired by the purchaser. The hydraulic cylinder 66 and 68 could also be replaced by other means to raise the screw jacks 62 and 64 upwardly and downwardly, such as an electric motor drive with appropriate worm gears or other drives within the spirit and scope of the invention.

When using the method herein described, the applicant's new and novel construction device could be used for moving construction materials from one floor of a building under construction to another floor. The method would comprise the steps of providing the construction device hereinbefore described and positioning the device on a given floor with a lifting crane usually associated with buildings under construction. A portion of the applicant's device would be positioned outside of the building with the remaining portion of the device being positioned inside the building. Thereafter the device would be locked in place with the uprightly positioned locking means shown in the preferred embodiment and the movable platform 14 could then be utilized to move inside the building, riding on the framework 18.

Thereafter construction workers could load the movable platform 14 with the concrete forms and other materials that are to be relocated to a different floor. The hydraulic motor 112 could then serve to move the platform and the construction material outside of the building as the removable platform is rolled along the channels 100 and 102. The outside lifting crane would then be utilized to pick up the construction material from the platform 14 and would relocate the construction material to a different floor where it could be reused. By repeating the steps of the method, all of the desired construction material could then be relocated from a lower floor to an upper floor as the building progresses during the pouring of the concrete at each given floor.

By repositioning the device to a different floor with the lifting crane, after unlocking it, the entire sequence could be repeated until the construction material has been completely relocated as desired. By following the sequence outlined, the entire building may be quickly completed through the concrete phase using the applicant's new and novel construction device as a means for quickly relocating the construction forms. When the entire building has been serviced in this manner, the construction device would then be unlocked from the last floor that it occupied and would be removed from the building with the outside lifting crane.

From the foregoing it can be seen that there has been provided by the applicant's invention a new and novel construction device having a movable platform which may be quickly relocated from floor to floor during the construction of a concrete building or other type of building. The applicant's device may be safely locked to each given floor by the means hereinbefore described and with the use of the movable platform 14, the device may be loaded with construction forms and any other material that must be removed from the floor. The movable platform feature provides an important safety aid to the construction job since workers do not have to go outside of the building on a makeshift platform, thereby endangering their lives by accidentally falling from the platform. All of the loading of the construction forms and other materials is done inside of the building under construction.

From the foregoing it can be seen that there has been provided an important advancement in the art as shown in the preferred embodiment and detailed in the drawings. Nevertheless it should be noted that structural features of the applicant's invention may be changed and the arrangement of the various parts of the invention and steps in the method may be changed without departing from the spirit and scope of the invention. The applicant is not to be limited to the exact embodiment shown and steps in the method described, which have been given by way of illustration only.

Having described my invention, I claim:

1. A removable construction device for use on a building under construction, the device being positioned partly inside the building and partly cantilevered outside of the building and having a movable platform section that may be positioned inside or outside of the building on the device, comprising:

(a) a frame;

(b) a movable platform section positioned on and carried by the frame, the platform section being designed to be movable on the frame from a position outside of the building to a position inside the building for moving a load into or out of the building;

(c) means, associated with the frame and the platform section, for moving the platform section; and (d) means associated with a portion of the frame and the building, for locking the frame to the building prior to moving a load into or out of the building.

2. The device as defined in claim 1 further comprising:

(e) means, associated with the frame, and fixedly attached thereto, for guiding the frame within the building whenever the frame is positioned for use on a predetermined floor of the building.

3. The device as defined in claim 2 wherein the guiding means comprises a roller.

4. The device as defined in claim 2 wherein the guiding means comprises a skid plate.

5. The device as defined in claim 2 further comprising:

(f) lifting means fixedly attached to the frame, for lifting the device from one floor of the building to another floor.

6. The device as defined in claim 5 further comprising the lifting means comprising a spreader bar pivotably mounted on the frame.

7. The device as defined in claim 1 further comprising the frame having fixedly attached thereto on one end thereof a reinforcing stop member, the stop member being fixed on the bottom surface of the frame and serving to act as a stop for the frame whenever the device was positioned on the floor of the building, the stop member serving also to reinforce the portion of the frame positioned outside of the building.

8. The device as defined in claim 7 further comprising:

(e) means, associated with the frame, and fixedly attached thereto, for holding the frame within the building whenever the frame is positioned for use on a predetermined floor of the building.

9. The device as defined in claim 8 further comprising:

(f) lifting means fixedldy attached to the frame, for lifting the device from one floor of the building to another floor.

10. The device as defined in claim 1 wherein the means for moving the platform comprises a hydraulic motor.

11. The device as defined in claim 1 wherein the locking means comprises at least one upright locking section having positioned thereon at least one screw jack.

12. The device as defined in claim 11 wherein the upright locking section is adjustable in a vertical direction and is movable by means of a hydraulic cylinder.

13. The device as defined in claim 12 further comprising the upright locking section having positioned therein a locking pin.

14. A removable construction device for use on a building under construction, the device being positioned partly inside the building and partly cantelevered outside the building and having a movable platform section that may be positioned inside or outside of the building on the device, comprising:

(a) a frame;

(b) a movable platform section slidably mounted on the frame;

(c) a hydraulic motor carried by the frame and associated with the platform section for moving the platform section on the frame;

(d) at least one locking member fixedly attached to the frame to lock the frame to the building, the locking section being adjustable vertically and being moved during adjustment by means of a hydraulic cylinder and being locked in place by means of a pin, the locking section further comprising at least one screw jack positioned on top thereof and fixedly attached thereto;

(e) a pair of rollers attached to one end of the frame for guiding the device within the building; and (f) a spreader bar pivotably mounted on the frame for lifting the device from floor to floor.

15. A method for moving construction material from one floor of a building under construction to another floor, comprising the steps of:

(a) providing a removable construction device having a a movable platform formed therein and locking means for the device;

(b) positioning the device on a predetermined floor with a lifting crane with a portion of the device being outside the building;

(c) locking the device in place with the locking means;

(d) moving the platform inside the building on the device;

(e) loading the platform with the construction material to be relocated to a different floor;

(f) moving the platform and the construction material outside of the building on the device;

(g) picking up the construction material from the platform using the lifting crane and relocating it to a different floor; and (h) repeating steps (d) to (g) until all the desired construction material has been relocated.

16. The method as defined in claim 15 further comprising the steps of:

(i) repositioning the device to a different floor with the lifting crane after unlocking it; and (j) repeating steps (b) to (g) until the construction material has been completely relocated.

17. The method as defined in claim 16 further comprising the steps of:

(k) repeating steps (i) to (j) until the entire building has been completed.

18. The method as defined in claim 17 further comprising the steps of:

(l) unlocking the device; and (m) removing the device by lifting it from the floor with the lifting crane.

* * * * *